US006953750B1

(12) United States Patent
Wu et al.

(10) Patent No.: US 6,953,750 B1
(45) Date of Patent: Oct. 11, 2005

(54) METHODS AND SYSTEMS FOR CONTROLLING BELT SURFACE TEMPERATURE AND SLURRY TEMPERATURE IN LINEAR CHEMICAL MECHANICAL PLANARIZATION

(75) Inventors: Patrick P. H. Wu, Milpitas, CA (US); Xuyen Pham, Fremont, CA (US); Tuan A. Nguyen, San Jose, CA (US); Ren Zhou, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 297 days.

(21) Appl. No.: 10/261,568

(22) Filed: Sep. 30, 2002

(51) Int. Cl.[7] ..... H01L 21/302
(52) U.S. Cl. ..... 438/691; 438/692; 451/7
(58) Field of Search ..... 438/691, 692, 438/693; 451/7, 53, 296, 60; 156/345.12, 156/345.11

(56) References Cited

U.S. PATENT DOCUMENTS 5,478,435 A * 12/1995 Murphy et al. ..... 438/693
5,722,875 A * 3/1998 Iwashita et al. ..... 451/8
6,000,997 A * 12/1999 Kao et al. ..... 451/7
6,207,555 B1 * 3/2001 Ross ..... 438/633
6,224,461 B1 5/2001 Boehm, Jr. et al. ..... 451/7
6,315,635 B1 * 11/2001 Lin ..... 451/7

* cited by examiner

*Primary Examiner*—Lan Vinh
(74) *Attorney, Agent, or Firm*—Martine Penilla & Gencarella, L.L.P.

(57) ABSTRACT

A linear chemical mechanical planarization (CMP) system includes a belt pad, a slurry bar having a plurality of nozzles, and a heating module for heating slurry. The heating module has a plurality of heating elements, each of which is coupled in flow communication with one of the plurality of nozzles of the slurry bar. The system also may include a control system for controlling the heating elements of the heating module and first and second temperature sensors coupled to the control system. The first temperature sensors measure the temperature of slurry heated by each of the heating elements, and the second temperature sensors measure the temperature of the surface of the belt pad. A method for dispensing slurry in a linear CMP system, and methods for controlling the temperature of the surface of the belt pad and the temperature of slurry in a linear CMP system also are described.

4 Claims, 5 Drawing Sheets

METHODS AND SYSTEMS FOR CONTROLLING BELT SURFACE TEMPERATURE AND SLURRY TEMPERATURE IN LINEAR CHEMICAL MECHANICAL PLANARIZATION

CROSS REFERENCE TO RELATED APPLICATION

This application is related to U.S. patent application Ser. No. 10/041,027, filed on Dec. 28, 2001, and entitled "Methods and Apparatus for Conditioning and Temperature Control of a Processing Surface." The disclosure of this application, which is assigned to Lam Research Corporation, the assignee of the subject application, is incorporated herein by reference.

BACKGROUND OF THE INVENTION

The present invention relates generally to semiconductor fabrication and, more particularly, to methods and systems for controlling the temperature of the surface of the belt pad and the slurry temperature in linear chemical mechanical planarization (CMP).

Generally speaking, linear CMP processes involve a wafer being rotated under pressure against the surface of a belt pad in the presence of a slurry, which contains a mixture of abrasive material and chemicals. The slurry is typically provided by a slurry bar, which is disposed above the belt pad and has a plurality of nozzles. In operation, the nozzles dispense slurry onto the surface of the belt pad. During planarization, the removal rate across the surface of the wafer is influenced by the temperature profile across the belt pad. For example, the removal rate at the edges of the wafer tends to be less than the removal rate at the center of the wafer because the temperature at the edges of the belt pad tends to be lower than at the center of the belt pad, especially at the start of a CMP operation. In light of this problem, which is sometimes referred to as the "wafer effect," it is often necessary to run a number of dummy wafers before a stable removal rate and acceptable within-wafer nonuniformity (WIWNU) are obtained and the processing of actual process wafers can begin.

In view of the foregoing, there is a need for a method that allows a greater degree of control over the temperature profile across the surface of a belt pad.

SUMMARY OF THE INVENTION

Broadly speaking, the present invention fills this need by providing a linear chemical mechanical planarization (CMP) system in which the temperature of the slurry dispensed from each of the nozzles of a slurry bar can be individually controlled during a CMP operation.

In accordance with one aspect of the present invention, a linear CMP system is provided. The system includes a belt pad, a slurry bar having a plurality of nozzles disposed above the belt pad, and a heating module for heating slurry. The heating module has a plurality of heating elements, with each of the heating elements being coupled in flow communication with one of the plurality of nozzles of the slurry bar. The system also may include a control system for controlling the heating elements of the heating module and first and second temperature sensors coupled to the control system. The first temperature sensors measure the temperature of slurry heated by each of the heating elements, and the second temperature sensors measure the temperature of the surface of the belt pad.

In one embodiment, the heating elements are comprised of quartz. In one embodiment, the first temperature sensors are thermocouples and the second temperature sensors are infrared sensors.

In accordance with another aspect of the present invention, a method for dispensing slurry in a linear CMP system is provided. In this method, each of a plurality of individually heated slurry supply sources is coupled in flow communication with one of a plurality of nozzles of a slurry bar. The temperature of slurry in each of the slurry supply sources is controlled so that each of the plurality of nozzles of the slurry bar dispenses slurry at a desired temperature.

In one embodiment, the controlling of the temperature of slurry includes monitoring the temperature of the surface of a belt pad, and adjusting the temperature of slurry in each of the slurry supply sources so that each of the plurality of nozzles of the slurry bar dispenses slurry at the desired temperature. In one embodiment, the temperature of the surface of the belt pad is measured across the width of the belt pad with infrared sensors. In one embodiment, the controlling of the temperature of slurry includes the use of feedback control. In one embodiment, the feedback control includes cascade loop control.

In accordance with yet another aspect of the present invention, a method for controlling belt surface temperature in a linear CMP system is provided. In this method, a temperature of a belt pad is measured at a series of points across the belt pad corresponding to nozzles of a slurry bar disposed above the surface of the belt pad. For each of the series of points, a first difference corresponding to a temperature difference between the measured temperature of the surface of the belt pad and a set temperature is determined. For each of the series of points, the first difference is conditioned with a first controller to obtain a first result. Next, for each of the series of points, a second difference corresponding to a temperature difference between the first result and a slurry temperature from a heated slurry supply source corresponding to a nozzle of the slurry bar is determined. For each of the series of points, the second difference is conditioned with a second controller to obtain a second result. Thereafter, for each of the series of points, the second result is used to adjust the slurry temperature in the heated slurry supply source.

In one embodiment, the set temperatures are supplied by an operator of the linear CMP system. In one embodiment, the first and second controllers are proportional integral derivative (PID) controllers.

In accordance with a further aspect of the present invention, a method for controlling slurry temperature in a linear CMP system is provided. In this method, a slurry bar having a plurality of nozzles is provided. The temperature of slurry dispensed from each of the plurality of nozzles is individually controlled. In one embodiment, the individual controlling of the temperature of slurry includes monitoring the temperature of slurry dispensed from each of the plurality of nozzles, and adjusting the temperature of slurry dispensed from each of the plurality of nozzles to maintain a desired temperature.

In one embodiment, the desired temperature is supplied by an operator of the linear CMP system. In one embodiment, the monitoring of the temperature of slurry dispensed from each of the plurality of nozzles includes monitoring the temperature of the surface of the belt pad. In one embodiment, the individual controlling of the temperature of slurry dispensed from each of the plurality of nozzles includes the use of feedback control. In one embodiment, the feedback control includes cascade loop control.

The linear CMP system of the present invention enables the temperature of the slurry dispensed from each of the nozzles of a slurry bar to be individually controlled. By controlling the temperature of slurry dispensed from each of the nozzles of a slurry bar, a desired temperature profile, e.g., one formulated to yield a uniform removal rate across the surface of the wafer, can be maintained across the surface of the belt pad. In preliminary tests conducted to date, it has been found that the linear CMP system and methods of the present invention enable a stable removal rate and within-wafer nonuniformity (WIWNU) to be obtained right from the first wafer. As such, the linear CMP system and methods of the present invention increase the efficiency with which CMP operations can be conducted by eliminating the "wafer effect" problem described above.

It is to be understood that the foregoing general description and the following detailed description are exemplary and explanatory only, and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE EXEMPLARY EMBODIMENTS

Several exemplary embodiments of the invention will now be described in detail with reference to the accompanying drawings.

Figure 1:
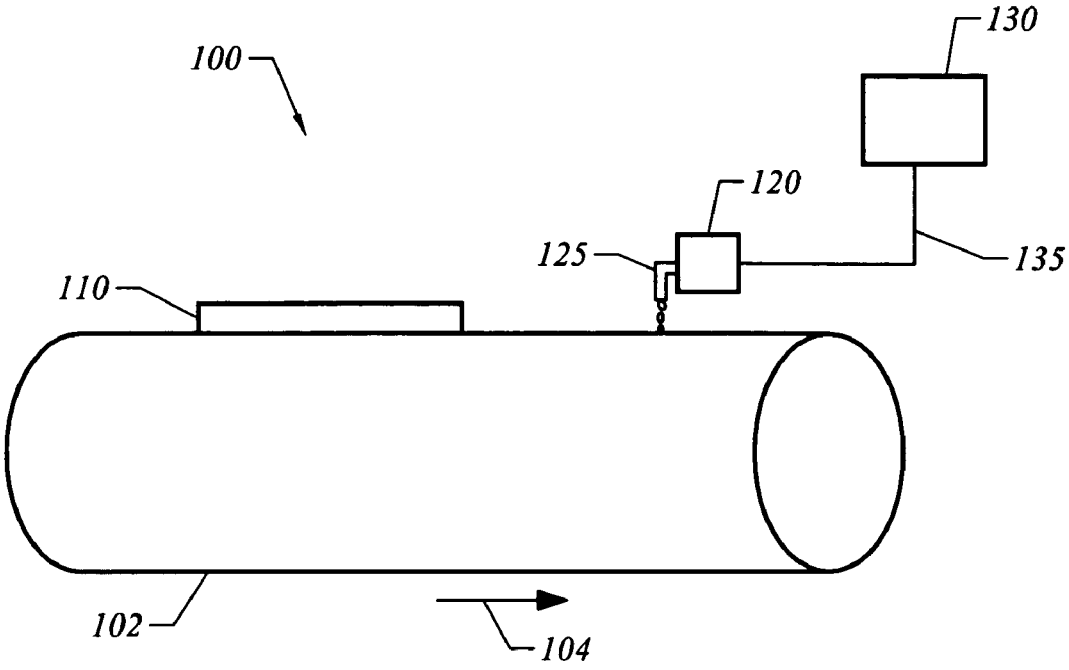
FIG. 1 is a simplified side view of a linear chemical mechanical planarization (CMP) system in accordance with one embodiment of the present invention.

FIG. 1 is a simplified side view of a linear CMP system 100 in accordance with one embodiment of the present invention. As shown in FIG. 1, linear CMP system 100 includes a belt pad 102 moving in the direction indicated by arrow 104. A wafer 110 is disposed on the belt pad 102. As is known to those skilled in the art, a polishing head (not shown) supports the wafer and applies downward pressure on the wafer. A heating module 130 heats slurry received from a source of slurry (not shown) and delivers heated slurry through slurry supply lines 135 to a slurry bar 120. The slurry bar 120 delivers slurry to the belt pad 102 via nozzles 125. Additional details of the heating module and the slurry bar are described below with reference to FIG. 2.

Figure 2:
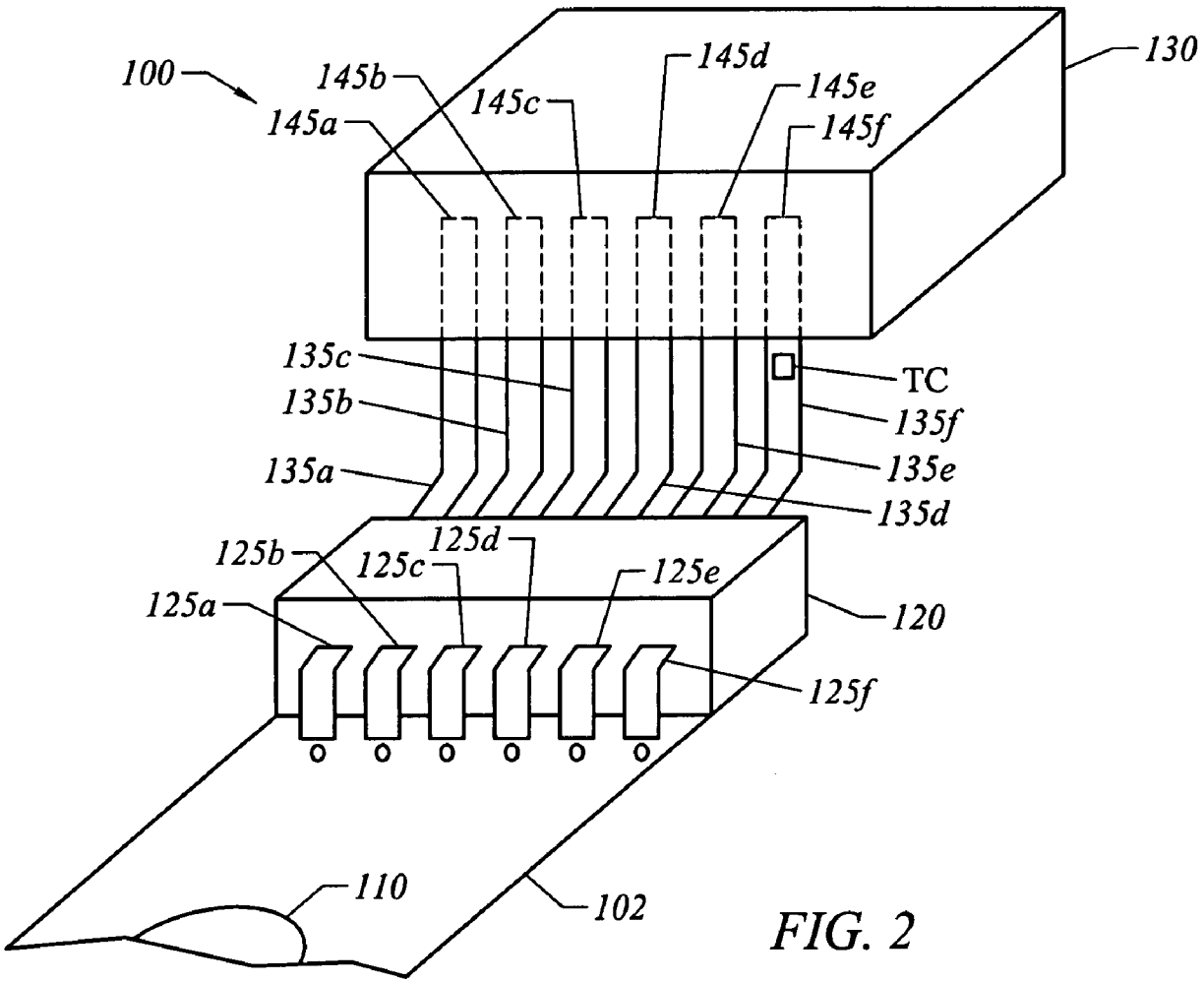
FIG. 2 is a simplified perspective view that shows additional details of the linear CMP system shown in FIG. 1.

FIG. 2 is a simplified perspective view that shows additional details of the linear CMP system 100 shown in FIG. 1. As shown in FIG. 2, heating module 130 is located above slurry bar 120 and includes heating elements 145*a*–145*f* (indicated by the dashed lines in FIG. 2). Each of the heating elements 145*a*–145*f* is separately controlled, as will be described in more detail below. In one embodiment, the heating elements are made of quartz. The heating elements 145*a*–145*f* are coupled in flow communication with respective nozzles 125*a*–125*f* of the slurry bar 120 via respective slurry supply lines 135*a*–135*f*. The slurry supply lines 135*a*–135*f* transport the heated slurry from the heating module 130 to the respective nozzles 125*a*–125*f* of the slurry bar 120, with the aid of gravity. The temperature of the slurry in each of the slurry supply lines 135*a*–135*f* can be monitored with a suitable temperature sensor, e.g., a thermocouple. In one embodiment, a thermocouple is provided in each of the slurry supply lines 135*a*–135*f* proximate to the heating elements 145*a*–145*f*, e.g., at the position designated by the label TC in FIG. 2.

By providing a separate slurry supply line for each of the nozzles of the slurry bar, the temperature of the slurry dispensed onto belt pad 102 from each of the nozzles can be individually controlled. As such, the temperature of the surface of the belt pad 102 can be varied across the surface of the belt pad by controlling the temperature of the slurry dispensed from each of the nozzles. As shown in FIG. 2, heating module 130 is configured to supply heated slurry to the six nozzles 125*a*–125*f* of slurry bar 120. Those skilled in the art will appreciate that the heating module also may be configured to supply heated slurry to a slurry bar having a different number of nozzles.

Figure 3:
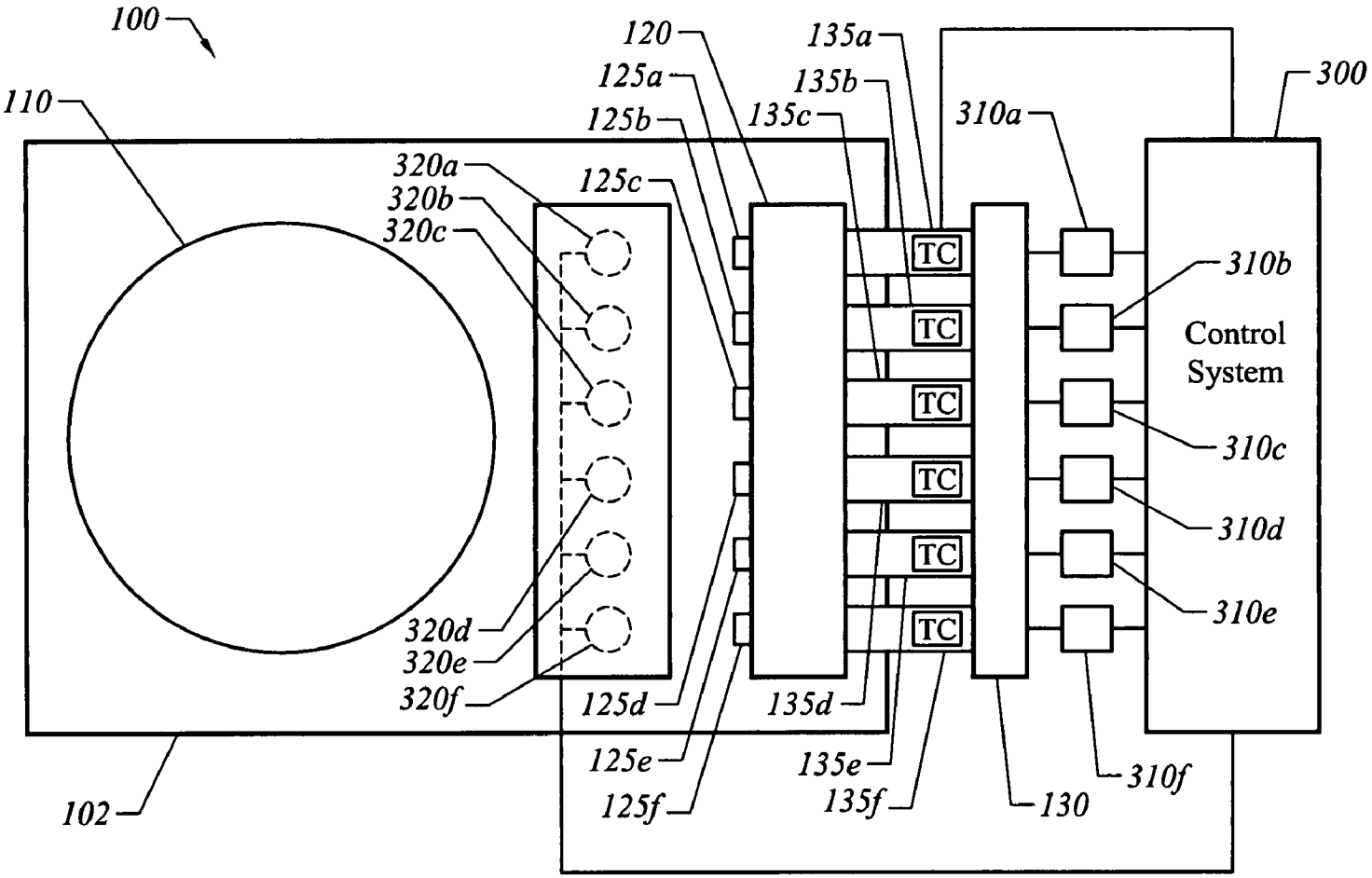
FIG. 3 is a simplified top view of a linear CMP system including an exemplary control system in accordance with one embodiment of the present invention.

FIG. 3 is a simplified top view of a linear CMP system 100 including a control system in accordance with one embodiment of the present invention. As shown in FIG. 3, linear CMP system 100 includes a control system 300 for controlling the heating module 130. The control system 300 is coupled to a plurality of temperature sensors 320*a*–320*f*, which are disposed over belt pad 102 to measure the temperature across the surface of the belt pad. In one embodiment, the temperature sensors are infrared sensors that are mounted on a suitable support, e.g., a bar. Power controllers 310*a*–310*f* are coupled between the control system 300 and the heating module 130 to control the power supplied to the heating elements of the heating module. In one embodiment, the power.

In operation, heating module 130 heats slurry and the heated slurry flows to slurry bar 120 through slurry supply lines 135*a*–135*f*. Slurry bar 120 dispenses the heated slurry onto the surface of belt pad 102 via nozzles 125*a*–125*f*. During the CMP operation, the temperature of the heated slurry in each of the slurry supply lines 135*a*–135*f* is measured by thermocouples TC provided in each of the slurry supply lines and this information is provided to the control system 300. The temperature of the surface of belt pad 102 is measured across the width of the belt pad by temperature sensors 320*a*–320*f* and this information is provided to the control system 300. The control system 300 processes the temperature data received from the thermocouples TC and the temperature sensors 320*a*–320*f* and adjusts the heating elements in the heating module 130 by controlling power controllers 310*a*–310*f* to maintain a desired temperature profile across the surface of the belt pad 102. Additional details regarding the operation of the control system are described below with reference to FIG. 4.

Figure 4:
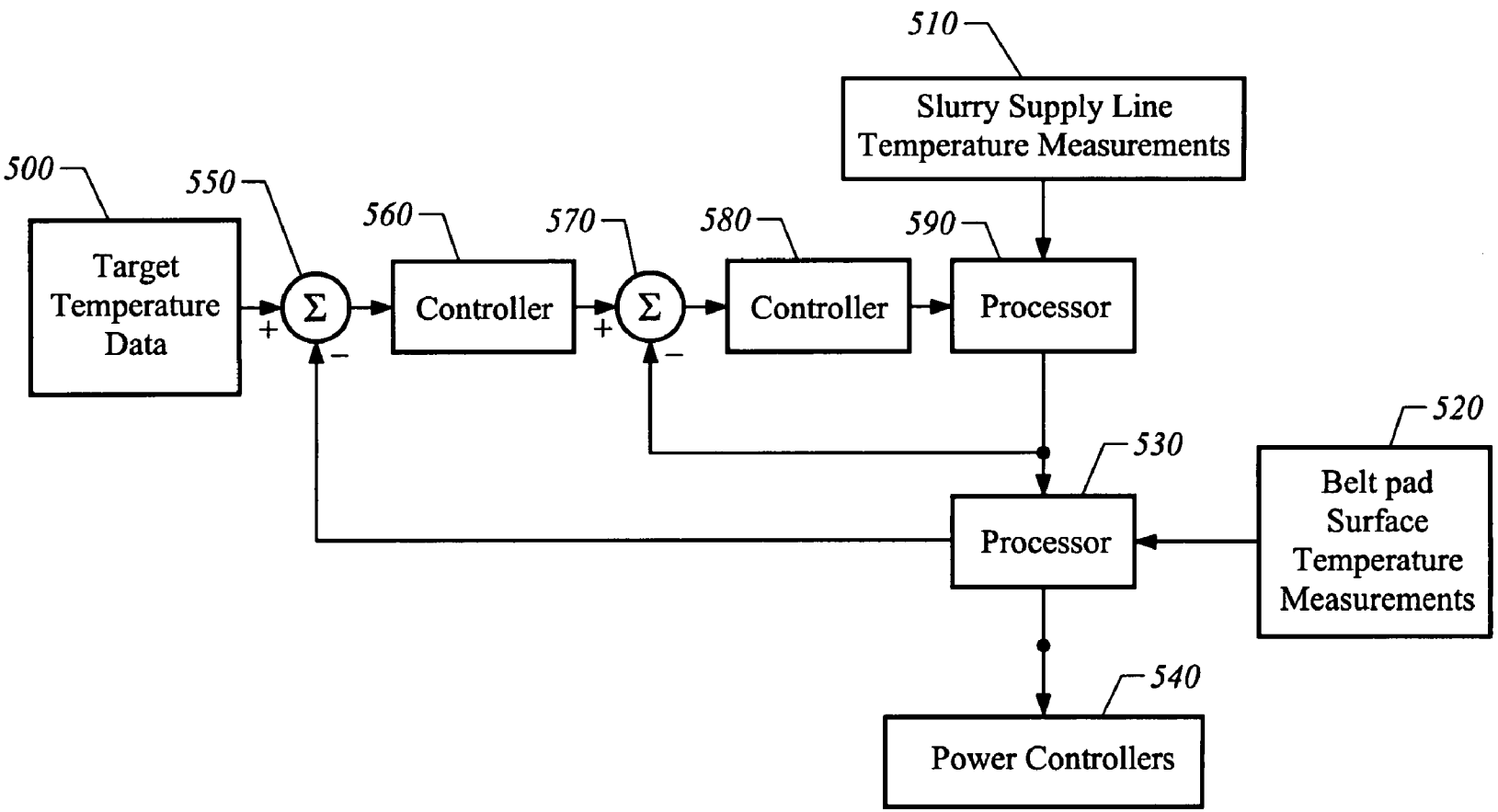
FIG. 4 is a block diagram of an exemplary cascade loop feedback control scheme that may be implemented in the control system to control the temperature of the surface of the belt pad and the temperature of slurry in accordance with one embodiment of the present invention.

FIG. 4 is a block diagram of an exemplary cascade loop feedback control scheme that may be implemented in control system 300 to control the temperature of the surface of the belt pad and the temperature of slurry in accordance with one embodiment of the present invention. Target temperature data, which is represented by block 500, is provided to a comparator, which is represented by block 550. The target temperature data may be input by an operator using any suitable method, e.g., manually through a graphical user interface (GUI) or automatically through a software program. In one embodiment, the target temperature data defines a desired temperature profile across the surface of the belt pad. The temperature measurements taken from the surface of the belt pad, which are represented by block 520, are provided to a suitable processor, which is represented by block 530. The temperature measurements taken from the slurry supply lines, which are represented by block 510, are provided to a suitable processor, which is represented by block 590.

The processor represented by block 530 converts the readings from the temperature sensors, e.g., infrared sensors, to numerical values and sends the numerical values to the comparator represented by block 550. This comparator compares the target temperature data of block 500 with the numerical values received from the processor of block 530. The output signal from the comparator of block 550 is input into a controller represented by block 560. In one embodiment, this controller is a proportional integral derivative (PID) controller that conditions the output signal from the comparator of block 550. It will be apparent to those skilled in the art that controllers other than PID controllers also may be used.

The output signal from the controller of block 560 is input into the comparator represented by block 570. The other input into the comparator of block 570 is the output signal from the processor of block 590. This processor converts the readings from the temperature sensors, e.g., thermocouples, in the slurry supply lines to numerical values and sends the numerical values to the comparator of block 570. The comparator of block 570 compares the output signal from the controller of block 560 with the numerical values corresponding to the slurry supply line temperature data received from the processor of block 590. This comparison is made to prevent over boil of the slurry in the heating module. The output signal from the comparator of block 570 is input into a controller represented by block 580. In one embodiment, this controller is a proportional integral derivative (PID) controller that conditions the output signal from the comparator of block 570.

The output signal from the controller of block 580 is input into the processor of block 590, which passes the signal onto the processor of block 530. This processor converts the signal into a DC voltage, which is then delivered to the power controllers, which are represented by block 540. The power controllers, e.g., SCRs, receive the control signal in DC voltage and provide an output in AC voltage to power the heating elements in the heating module so that the slurry is heated to the desired temperatures.

Figure 5:
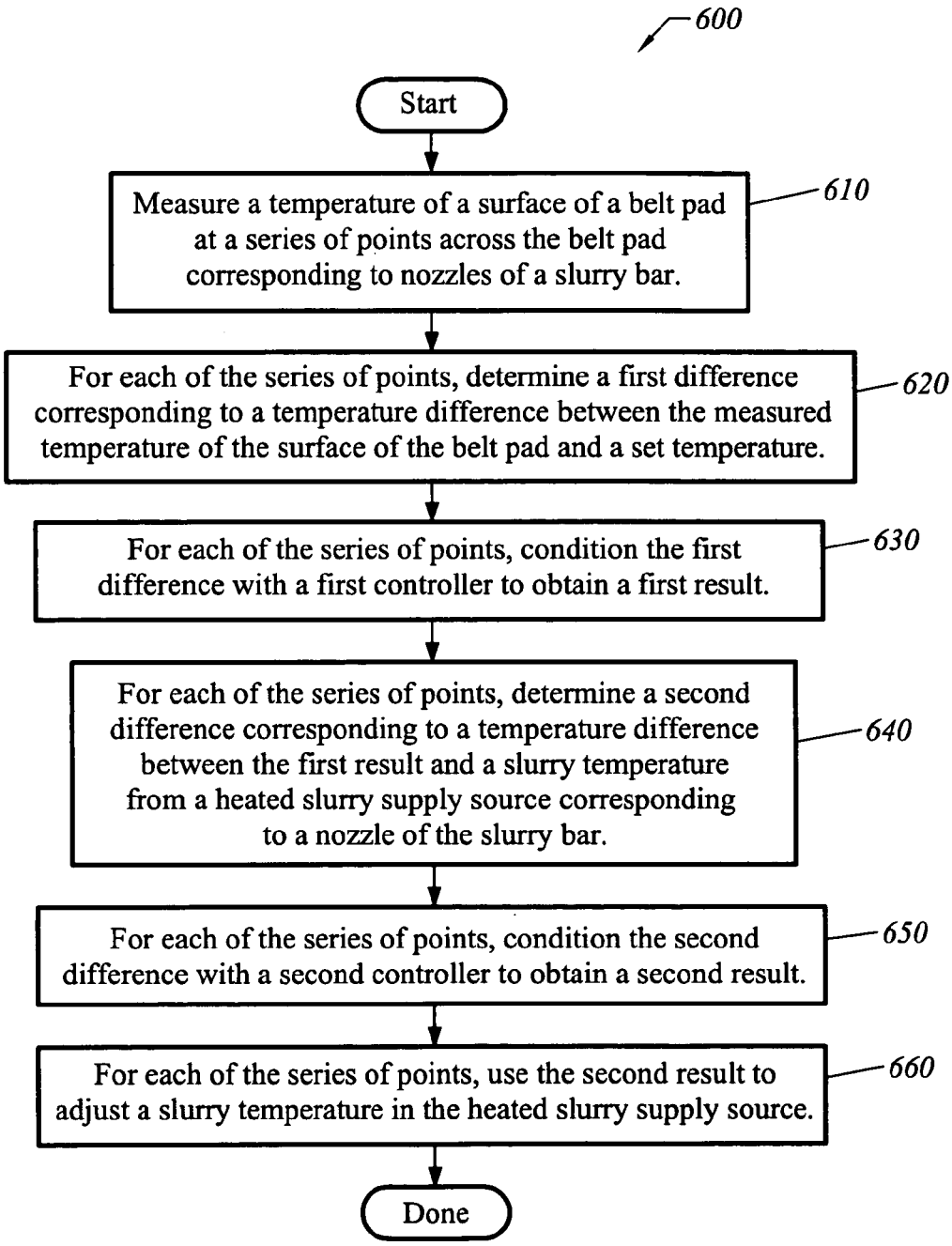
FIG. 5 is a flow chart diagram illustrating the method of operations performed in controlling the temperature of the surface of the belt pad in a linear CMP system in accordance with one embodiment of the present invention.

FIG. 5 is a flow chart diagram 600 illustrating the method of operations performed in a control system for controlling a temperature of a surface of a belt pad in a linear CMP system in accordance with one embodiment of the present invention. The method begins with operation 610, in which a temperature of a surface of a belt pad is measured at a series of points across the belt pad corresponding to nozzles of a slurry bar. The temperature measurements at the points across the surface of the belt pad may be made by arranging suitable temperature sensors at appropriate locations. In one embodiment, a number of infrared sensors are mounted on a support bar that is disposed above the belt pad (see, for example, infrared sensors 320*a*–320*f* shown in FIG. 3). In operation 620, for each of the series of points, a first difference corresponding to a temperature difference between the measured temperature of the surface of the belt pad and a set temperature is determined. In one embodiment, the set temperature defines a desired temperature profile across the surface of the belt pad. The set temperature may be provided by any suitable method, e.g., manually by an operator through a graphical user interface (GUI) or automatically through a software program. The difference between the measured temperature and the set temperature may be determined by any suitable device, e.g., a comparator (see, e.g., comparator 550 in FIG. 4).

In operation 630, for each of the series of points, the first difference is conditioned with a first controller to obtain a first result. The first difference may be conditioned with any suitable controller. In one embodiment, the first controller is a PID controller (see, e.g., controller 560 in FIG. 4). In operation 640, for each of the series of points, a second difference corresponding to a temperature difference between the first result and a slurry temperature from a heated slurry supply source corresponding to a nozzle of the slurry bar is determined. The second difference may be determined by any suitable device, e.g., a comparator (see, e.g., comparator 570 in FIG. 4).

In operation 650, for each of the series of points, the second difference is conditioned with a second controller to obtain a second result. The second difference may be conditioned with any suitable controller. In one embodiment, the second controller is a PID controller (see, e.g., controller 580 in FIG. 4). In operation 660, for each of the series of points, the second result is used to adjust a slurry temperature in the heated slurry supply source. Because the second result has been conditioned by the second controller (and the first result has been conditioned by the first controller), any change in slurry temperature will be implemented in a manner that avoids problems, e.g., an over boil situation. In one embodiment, after any necessary conversions, the second result is delivered to power controllers (see, e.g., controllers 310*a*–310*f* in FIG. 3 or power controllers 540 in FIG. 4), which power the heating elements in the heating module that heat the slurry. Once the slurry temperature in each of the heated slurry supply sources has been adjusted to the desired temperature, the method is done.

The linear CMP system of the present invention enables the temperature of the slurry dispensed from each of the nozzles of a slurry bar to be individually controlled. By controlling the temperature of slurry dispensed from each of the nozzles of a slurry bar, a desired temperature profile, e.g., one formulated to yield a uniform removal rate across the surface of the wafer, can be maintained across the surface of the belt pad. In preliminary tests conducted to date, it has been found that the linear CMP system and methods of the present invention enable a stable removal rate and within-wafer nonuniformity (WIVVNU) to be obtained right from the first wafer. As such, the linear CMP system and methods of the present invention increase the efficiency with which CMP operations can be conducted by eliminating the "wafer effect" problem described above.

In summary, the present invention provides a linear CMP system, a method for dispensing slurry in a linear CMP system, and methods for controlling the temperature of the surface of the belt pad and the temperature of slurry in a linear CMP system. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A method for controlling a temperature of a surface of a belt pad in a linear chemical mechanical planarization (CMP) system, comprising:

measuring a temperature of a surface of a belt pad at a series of points across the belt pad corresponding to nozzles of a slurry bar disposed above the surface of the belt pad;

for each of the series of points, determining a first difference corresponding to a temperature difference between the measured temperature of the surface of the belt pad and a set temperature;

for each of the series of points, conditioning the first difference with a first controller to obtain a first result;

for each of the series of points, determining a second difference corresponding to a temperature difference between the first result and a slurry temperature from a heated slurry supply source corresponding to a nozzle of the slurry bar;

for each of the series of points, conditioning the second difference with a second controller to obtain a second result; and for each of the series of points, using the second result to adjust a slurry temperature in the heated slurry supply source.

2. The method of claim 1, wherein the temperature of the surface of the belt pad is measured across the surface of the belt pad with infrared sensors.

3. The method of claim 1, wherein the set temperatures are supplied by an operator of the linear CMP system.

4. The method of claim 1, wherein the first and second controllers are proportional integral derivative controllers.

* * * * *